US008708325B2

(12) United States Patent
Hwang et al.

(10) Patent No.: US 8,708,325 B2
(45) Date of Patent: Apr. 29, 2014

(54) PAPER CLAMPING APPARATUS FOR OFFICE MACHINE

(75) Inventors: In Su Hwang, Incheon (KR); Jung Hwan Yoon, Gyeonggi-do (KR)

(73) Assignee: Sindoh Co., Ltd., Seoul (KR)

( * ) Notice: Subject to any disclaimer, the term of this patent is extended or adjusted under 35 U.S.C. 154(b) by 53 days.

(21) Appl. No.: 13/590,406

(22) Filed: Aug. 21, 2012

(65) Prior Publication Data

US 2013/0214474 A1 Aug. 22, 2013

(30) Foreign Application Priority Data

Sep. 1, 2011 (KR) ..... 10-2011-0088281

(51) Int. Cl.
*B65H 39/00* (2006.01)

(52) U.S. Cl.
USPC ..... 270/58.11; 270/58.12; 270/58.16; 270/58.17; 294/104

(58) Field of Classification Search
USPC ..... 270/58.07, 58.08, 58.11, 58.12, 58.16, 270/58.17; 414/790.3, 790.2; 198/644
See application file for complete search history.

(56) References Cited

U.S. PATENT DOCUMENTS

| | | | | |
|---|---|---|---|---|
| 4,588,070 | A * | 5/1986 | Smith | 198/468.3 |
| 5,395,151 | A * | 3/1995 | Eberle | 294/104 |
| 5,782,337 | A * | 7/1998 | Langland | 198/803.1 |
| 6,357,736 | B1 * | 3/2002 | Kubota et al. | 270/58.08 |
| 6,799,759 | B1 * | 10/2004 | McNamara et al. | 270/58.08 |
| 6,819,906 | B1 * | 11/2004 | Herrmann et al. | 399/368 |
| 7,172,194 | B2 * | 2/2007 | Terao et al. | 271/190 |
| 7,487,959 | B2 * | 2/2009 | Noh | 270/58.12 |
| 7,798,480 | B2 * | 9/2010 | Kikkawa et al. | 270/58.12 |
| 7,992,856 | B2 * | 8/2011 | Saito | 270/58.11 |
| 8,523,166 | B2 * | 9/2013 | Jung | 270/58.11 |
| 2005/0206065 | A1 * | 9/2005 | Herrmann et al. | 270/58.11 |

* cited by examiner

*Primary Examiner* — Patrick Mackey
(74) *Attorney, Agent, or Firm* — Nixon & Vanderhye P.C.

(57) ABSTRACT

Disclosed is a paper clamping apparatus for an office machine adapted to clamp a paper bundle outputted from the office machine while the paper bundle is being moved. A movable body adapted to move along a shaft by means of belt driving is included; a shaft holder connected to an end of the shaft at an end of the movable body and adapted to move along the shaft by means of a movement of the movable body; a base connected to the shaft at the other end of the movable body and adapted to move along the shaft by means of a movement of the movable body; and a clamp member adapted to operate so that, when the movable body moves, the paper bundle is clamped or released by means of link driving.

9 Claims, 5 Drawing Sheets

PAPER CLAMPING APPARATUS FOR OFFICE MACHINE

This application claims priority to KR Application No. 10-2011-0088281, filed 1 Sep. 2011, the entire contents of which is hereby incorporated herein by reference.

BACKGROUND OF THE INVENTION

1. Field of the Invention

The present invention relates to a paper clamping apparatus for an office machine (e.g. photocopier, printer, multifunction device), and more particularly to a paper clamping apparatus for an office machine, which can clamp and move a paper bundle without using a separate electronic component (e.g. solenoid).

2. Description of the Prior Art

As generally known in the art, the main function of image forming devices (e.g. photocopiers, printers) is to simply copy or print documents, but, in line with recent trends towards user convenience, they tend to be integrated with various devices to provide various additional functions.

For example, users have manually aligned outputted sheets of paper and bundled them using a stapler or a punch. Such stapling or punching can now be performed by a finisher device additionally mounted on a photocopier, for example.

Such an office machine (e.g. photocopier, printer, finisher device) employs an electronic device (e.g. solenoid) and clamps sheets of paper, which have been outputted or which have been set for post-processing, so that the bundle of paper is not set loose during transportation.

FIG. 1 schematically illustrates a conventional paper clamping apparatus for an office machine. Sheets of paper 10 that have been outputted or set are aligned inside a slot 20, and a plunger 40 is moved by operation of a solenoid 30 to press the paper 10. The bundle of sheets clamped in this manner is moved by an elevator 50 without being set loose.

However, such a conventional paper clamping apparatus for an office machine has a problem in that the use of a separate electronic component (e.g. solenoid) makes the structure complicated, increases the cost, and poses a possible malfunction of the electronic component.

SUMMARY OF THE INVENTION

Accordingly, the present invention has been made to solve the above-mentioned problems occurring in the prior art, and an object of the present invention is to provide a paper clamping apparatus for an office machine, which can clamp and move a paper bundle without using a separate electronic component (e.g. solenoid).

In order to accomplish this object, there is provided a paper clamping apparatus for an office machine adapted to clamp a paper bundle outputted from the office machine while the paper bundle is being moved, the paper clamping apparatus including a movable body adapted to move along a shaft by means of belt driving; a clamp base connected to the shaft at upper and lower ends of the movable body and adapted to move along the shaft by means of a movement of the movable body; and a clamp member installed on the clamp base and adapted to operate so that, when the movable body moves, the paper bundle is clamped or released by means of link driving.

Preferably, the clamp member includes a first clamp adapted to rotate about a transverse shaft installed on a lower end of the clamp base, the first clamp extending from the transverse shaft via a lower portion of a lateral surface of the movable body to an upper portion of the movable body so that sheets of paper can be received between the first clamp and the lateral surface of the movable body; a second clamp installed on an upper end of the clamp base and adapted to move in a direction facing the first clamp; and a link member adapted to operate so that, when the movable body moves, the first and second clamps move towards each other or away from each other.

More preferably, the link member includes a rotation bar having a streamlined slit, into which a protrusion pin of the second clamp is inserted, and a protrusion pin spaced from the slit in a direction facing away from the second clamp; and a link having one end connected to a protrusion pin provided in a position eccentric from the transverse shaft of the first clamp and the other end connected to the protrusion pin of the rotation bar.

Preferably, a spring is installed between the clamp base and a shaft holder supporting the shaft so that the movable body can move when driving force larger than elastic force from the spring is acting.

More preferably, the clamp base or the shaft holder is adapted to maintain a position spaced from the movable body by a predetermined distance before the movable body begins to move.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE EXEMPLARY EMBODIMENTS

Hereinafter, a paper clamping apparatus for an office machine according to an exemplary embodiment of the present invention will be described in detail with reference to the accompanying drawings. It is to be noted that, in the following description of the present invention, the terminology has been determined based on consideration of the function of each component, and is not to be interpreted as limiting technical components of the present invention.

Figure 1:
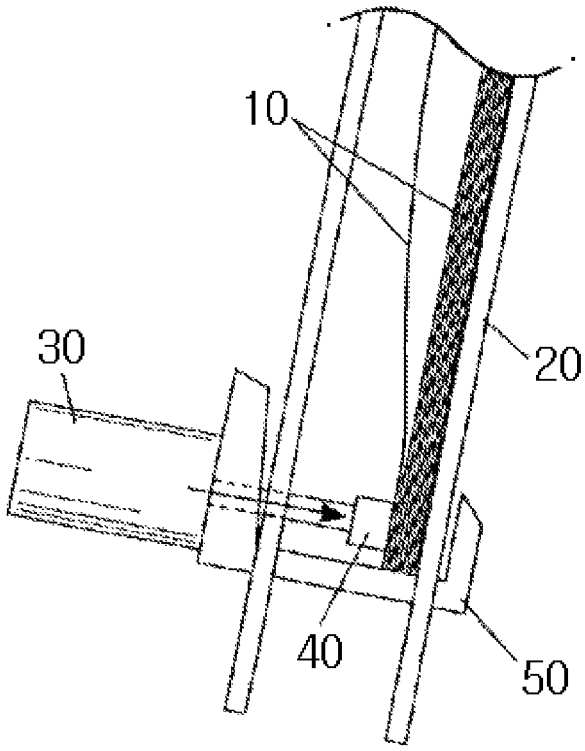
FIG. 1 schematically illustrates a conventional paper clamping apparatus for an office machine.
Figure 2:
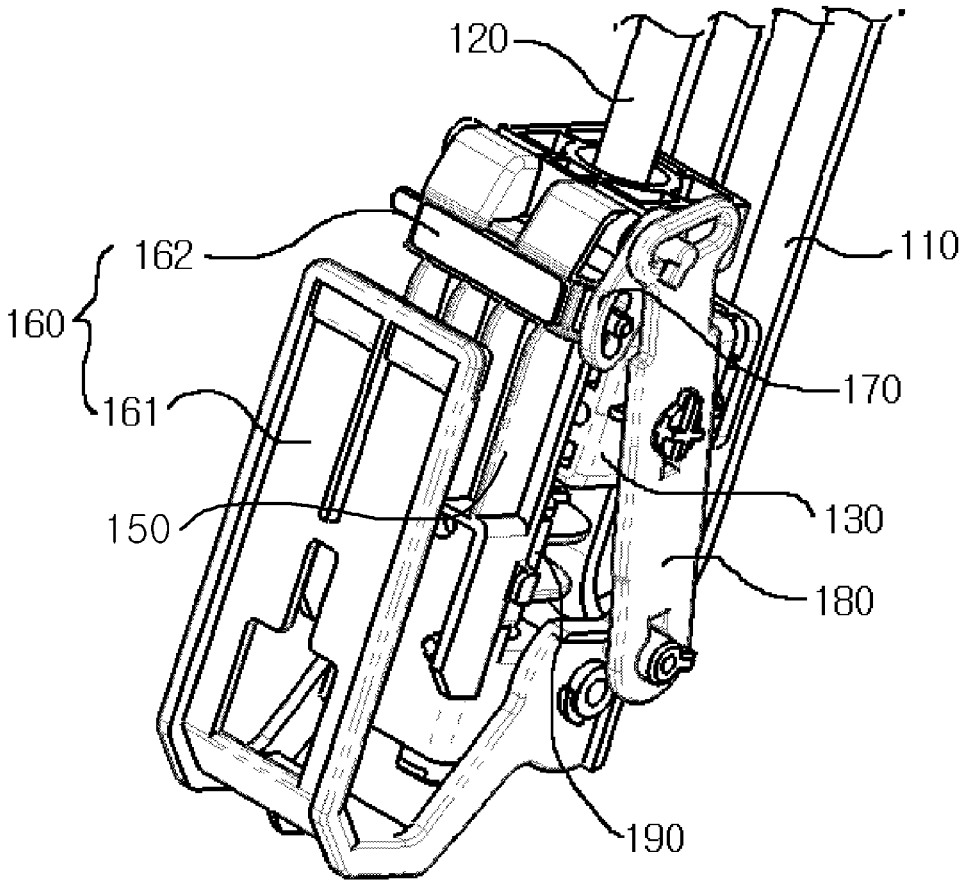
FIG. 2 is a perspective view of a paper clamping apparatus for an office machine according to the present invention.
Figure 3:
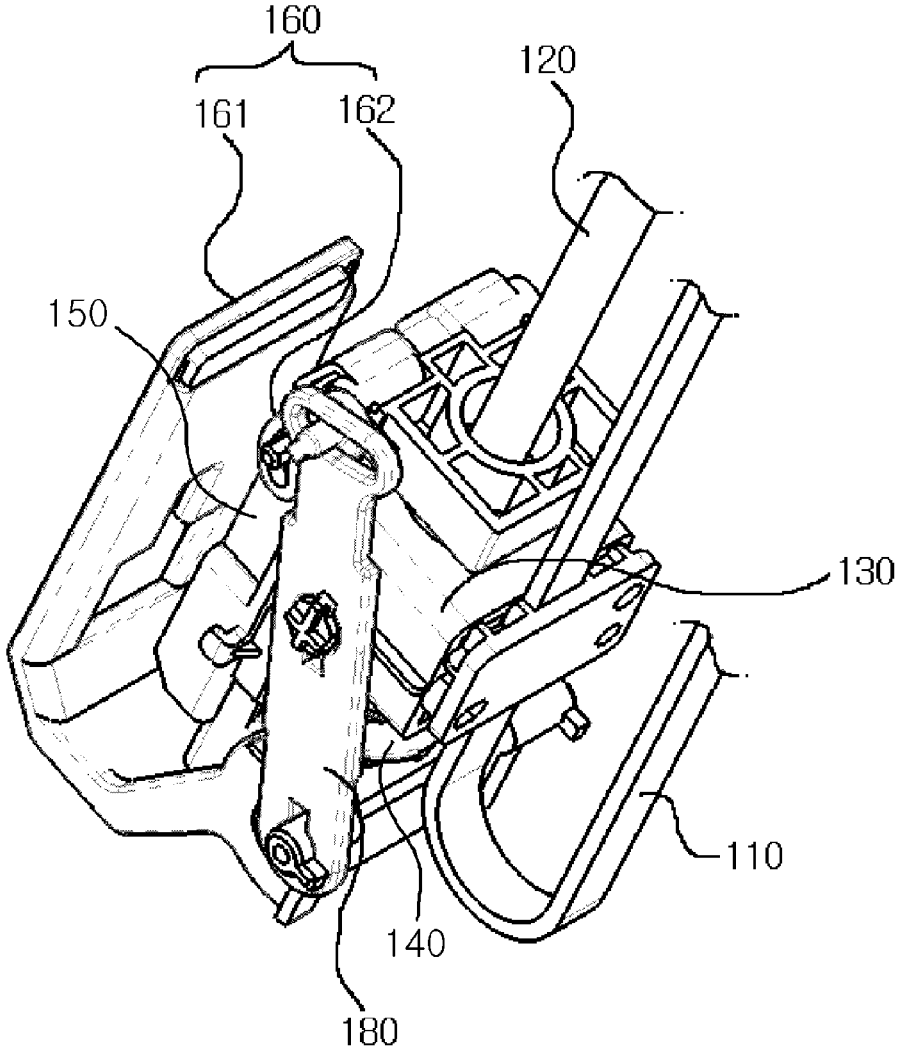
FIG. 3 is a perspective view of the paper clamping apparatus for an office machine according to the present invention, seen from a different direction.
Figure 4:
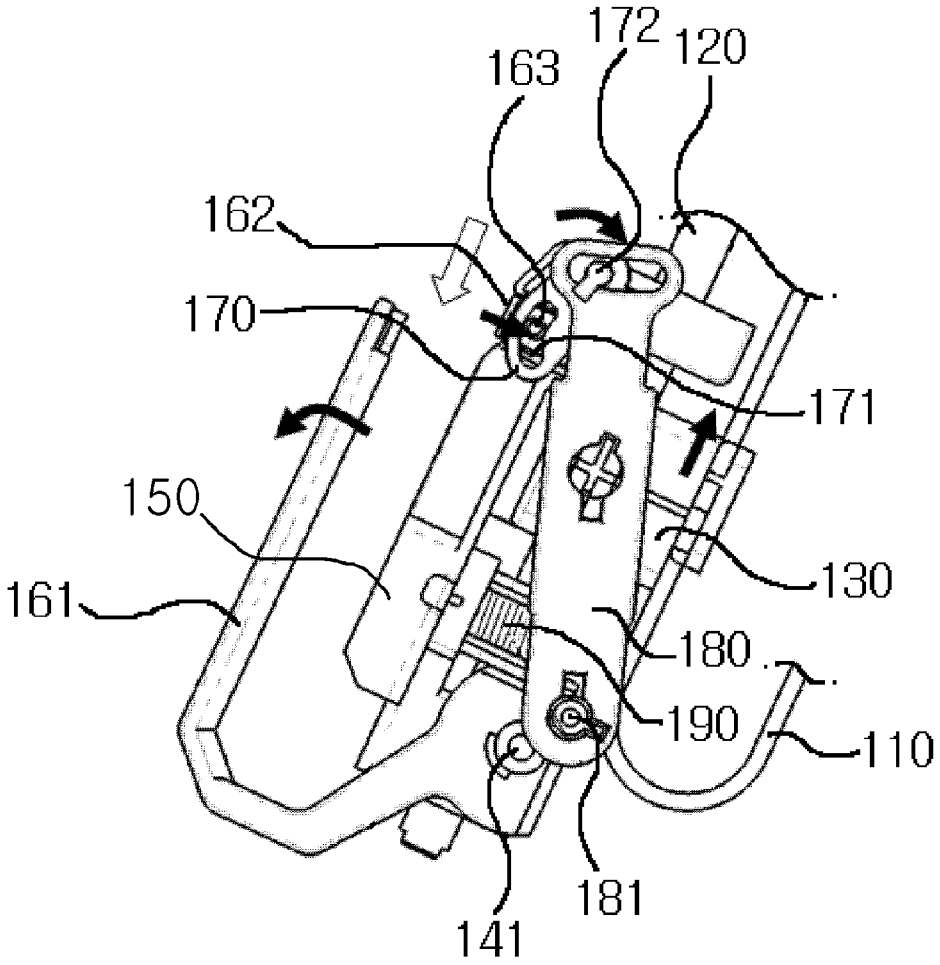
FIG. 4 illustrates an operational state of the paper clamping apparatus for an office machine according to the present invention while its movable body is ascending.
Figure 5:
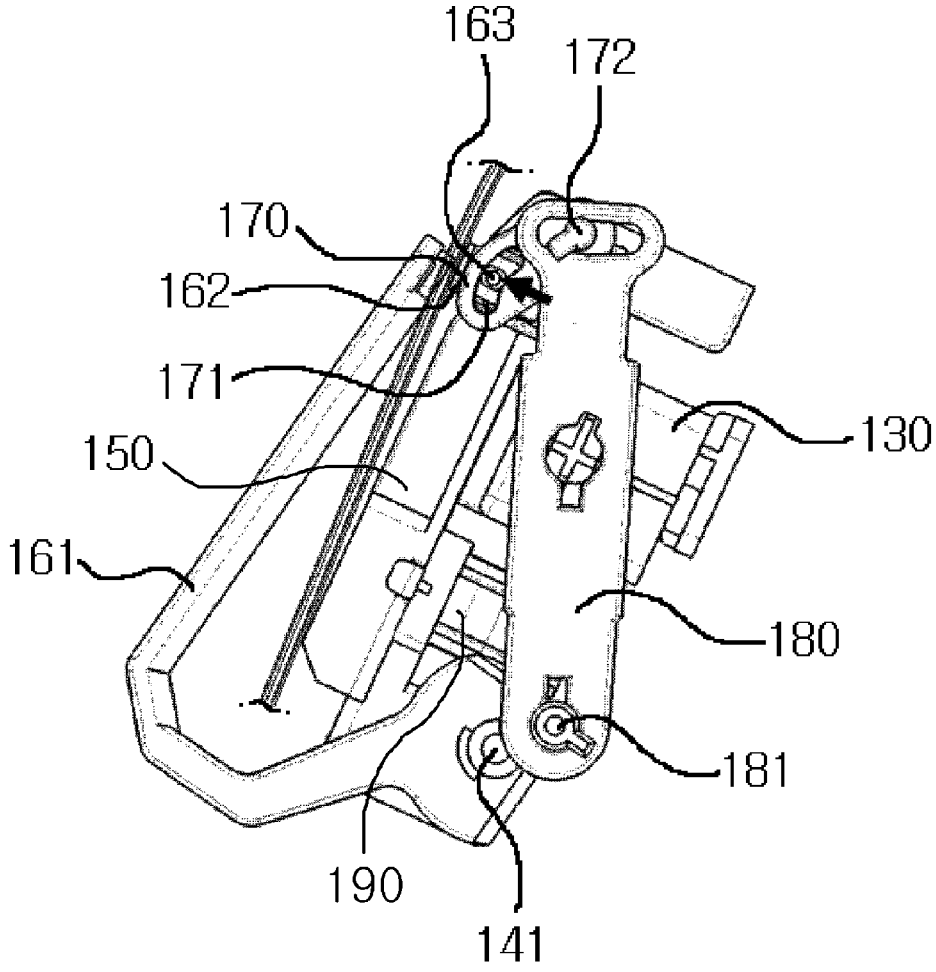
FIG. 5 illustrates an operational state of the paper clamping apparatus for an office machine according to the present invention while its movable body is descending.

FIG. 2 is a perspective view of a paper clamping apparatus for an office machine according to the present invention; FIG. 3 is a perspective view of the paper clamping apparatus for an office machine according to the present invention, seen from a different direction; FIG. 4 illustrates an operational state of the paper clamping apparatus for an office machine according to the present invention while its movable body is ascending; and FIG. 5 illustrates an operational state of the paper clamping apparatus for an office machine according to the present invention while its movable body is descending.

As illustrated in FIGS. 2-5, the paper clamping apparatus for an office machine according to the present invention is adapted to clamp a bundle of sheets of paper, which have been outputted from an office machine (e.g. photocopier, printer, multifunction device) and aligned, so that they are prevented from being set loose during a movement.

Specifically, the paper clamping apparatus for an office machine according to the present invention includes a movable body 130 installed near an output portion of the office machine and adapted to move in an axial direction along a shaft 120 by means of driving of a belt 110; a shaft holder 140 installed on an end of the shaft 120 at an end of the movable body 130; a clamp base 150 installed in front of the movable body 130; and a clamp member 160 adapted to clamp or release a paper bundle by means of link driving during a movement of the movable body 130.

The movable body 130 is connected to the shaft 120 so as to move along the shaft 120. A lateral surface of the movable body 130 is connected to the belt 110 so that it can move in the longitudinal direction of the shaft 120 by means of driving of the belt 110. Specifically, the movable body 130 is connected to the belt 110, which has driving connection with a motor, so that the movable body 130 moves upwards/downwards according to motor driving and thus moves the entire clamping structure upwards/downwards.

The shaft holder 140 is connected to the shaft 120 so as to surround an end of the shaft 120 at the lower end of the movable body 130.

The clamp base 150 is installed so as to surround the front and upper sides of the movable body 130 and surround the front and lower sides of the shaft holder 140. The upper and lower ends of the clamp base 150 are connected to the shaft 120 so that it can move in the upward/downward direction along the shaft 120. A first clamp 161 (described later) is hinge-coupled to the lower end of the clamp base 150, and a second clamp 162 (described later) is installed on the upper end of the clamp base 150 to be able to protrude forwards.

The clamp member 160 defines a space, in which a paper bundle can be received, on one side of the movable body 130, and is adapted to clamp the paper bundle, when the movable body 130 descends, by means of link driving and release the paper bundle, when the movable body 130 ascends.

The clamp member 160 includes a first clamp 161 spaced from a lateral surface of the movable body 130 and a second clamp 162 adapted to face the first clamp 161 above the lateral surface of the movable body 130. The first and second clamps 161 and 162 are adapted to move away from each other by means of link driving, when the movable body 130 ascends, and move towards each other when the movable body 130 descends.

The first clamp 161 is installed to be able to rotate about a transverse shaft 141 installed on the lower end of the clamp base 150, and extends from the transverse shaft 141 through the lower portion of the lateral surface of the movable body 130 to the upper portion of the movable body 130 in a ring shape, so that sheets of paper can be received between the first clamp 161 and the lateral surface of the movable body 130.

The second clamp 162 is installed between the upper end of the clamp base 150 and the movable body 130 and is adapted to move in a direction facing the first clamp 161.

A link member is installed between the first and second clamps 161 and 162 and is adapted so that, when the movable body 130 moves, the first and second clamps 161 and 162 move towards each other or away from each other by means of link driving.

Preferably, the link member includes a rotation bar 170 installed near the second clamp 162 and a link 180 adapted to connect the rotation bar 170 and the first clamp 161.

The rotation bar 170 has a streamlined slit 171, into which a protrusion pin 163 formed on the second clamp 162 is inserted, and a protrusion pin 172 spaced from the slit 171 in a direction facing away from the second clamp 162.

The link 180 has one end connected to a protrusion pin 181 lying in an eccentric position deviating outwards from the transverse shaft 141 of the first clamp 161 and the other end connected to the protrusion pin 172 of the rotation bar 170.

Such a structure causes the following operations: when the movable body 130 ascends by means of driving of the belt 110, the link 180 ascends, and the first clamp 161 is rotated outwards as much as a predetermined angle by the eccentric protrusion pin 181 and thus moved away from the movable body 130. At the same time, the rotation bar 170 is rotated in the rightward direction with reference to FIG. 4 by means of an interlock between the protrusion pin 163 of the second clamp 162 and the streamlined slit 171, so that the second clamp 162 moves rightwards. As a result, the first and second clamps 161 and 162 move away from each other and release the paper bundle (refer to FIG. 4).

On the other hand, when the movable body 130 descends by means of driving of the belt 110, the link 180 also descends. As a result, the rotation bar 170 rotates in the leftward direction with reference to FIG. 5, so that the second clamp 162 moves leftwards. At the same time, the first clamp 161 rotates towards the movable body 130 as much as a predetermined angle and reaches a position adjacent to the second clamp 162. Consequently, the first and second clamps 161 and 162 are forced against each other to clamp the paper bundle (refer to FIG. 5).

As such, the paper clamping apparatus for an office machine according to the present invention can clamp or release a paper bundle by means of mechanical link driving, without using a separate electronic component (e.g. solenoid), making the structure simple and reducing the manufacturing cost.

Preferably, a spring 190 is installed between the clamp base 150 and the shaft holder 140. The spring 190 is adapted to retain the shaft holder 140 and the clamp base 150, while the movable body 130 moves upwards/downwards to a predetermined extent, so that the clamp base 150 does not move.

More particularly, the elastic force from the spring 190 prevents the clamp base 150 from moving, while the movable body 130 is moving to a predetermined extent, but the clamp base 150 is allowed to move as soon as the movable body 130 contacts the upper or lower end of the clamp base 150.

When the movable body 130 is ascending, the first clamp 161 is spaced from the clamp base 150, and the second clamp 162 moves rightwards, leaving the clamp member 150 in an open state. When the movable body 130 is descending, on the other hand, the first clamp 161 comes close to the clamp base 150, and the second clamp 162 moves leftwards, leaving the clamp member 150 in a closed state. Therefore, the clamp member 150, in the closed state, can move while clamping the paper bundle.

As such, the spring 190 is installed so that the clamp base 150 and the shaft holder 140 keep pressing the shaft 140, and the movable body 130 can move against the elastic force from the spring 190 only when the movable body 130 has at least a predetermined load, i.e. when the driving force of the movable body 130 exceeds the elastic force from the spring 190.

The clamp base 150 is installed to maintain a position spaced from the movable body 130 by a predetermined distance, before the movable body 130 begins to move.

Therefore, there is a time difference between when the movable body 130 begins to move against the elastic force from the spring 190 and when the clamp base 150 is moved by the movable body 130, and the link member operates during the time difference and actuates the first and second clamps 161 and 162.

The paper clamping apparatus for an office machine according to the present invention is advantageous in that, by operating a clamp member in a link driving type and clamping aligned sheets of paper, the structure is made simple and the manufacturing cost is reduced.

Although an exemplary embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A paper clamping apparatus for an office machine adapted to clamp a paper bundle outputted from the office machine while the paper bundle is being moved, the paper clamping apparatus comprising:

a movable body adapted to move along a shaft by means of belt driving;

a clamp base connected to the shaft at upper and lower ends of the movable body and adapted to move along the shaft by means of a movement of the movable body; and a clamp member installed on the clamp base and adapted to operate so that, when the movable body moves, the paper bundle is clamped or released by means of link driving.

2. The paper clamping apparatus for an office machine as claimed in claim 1, wherein the clamp member comprises:

a first clamp adapted to rotate about a transverse shaft installed on a lower end of the clamp base, the first clamp extending from the transverse shaft via a lower portion of a lateral surface of the movable body to an upper portion of the movable body so that sheets of paper can be received between the first clamp and the lateral surface of the movable body;

a second clamp installed on an upper end of the clamp base and adapted to move in a direction facing the first clamp; and a link member adapted to operate so that, when the movable body moves, the first and second clamps move towards each other or away from each other.

3. The paper clamping apparatus for an office machine as claimed in claim 2, wherein the link member comprises:

a rotation bar having a streamlined slit, into which a protrusion pin of the second clamp is inserted, and a protrusion pin spaced from the slit in a direction facing away from the second clamp; and a link having one end connected to a protrusion pin provided in a position eccentric from the transverse shaft of the first clamp and the other end connected to the protrusion pin of the rotation bar.

4. The paper clamping apparatus for an office machine as claimed in claim 1, wherein a spring is installed between the clamp base and a shaft holder supporting the shaft so that the movable body can move when driving force larger than elastic force from the spring is acting.

5. The paper clamping apparatus for an office machine as claimed in claim 4, wherein the clamp base or the shaft holder is adapted to maintain a position spaced from the movable body by a predetermined distance before the movable body begins to move.

6. The paper clamping apparatus for an office machine as claimed in claim 2, wherein a spring is installed between the clamp base and a shaft holder supporting the shaft so that the movable body can move when driving force larger than elastic force from the spring is acting.

7. The paper clamping apparatus for an office machine as claimed in claim 3, wherein a spring is installed between the clamp base and a shaft holder supporting the shaft so that the movable body can move when driving force larger than elastic force from the spring is acting.

8. The paper clamping apparatus for an office machine as claimed in claim 6, wherein the clamp base or the shaft holder is adapted to maintain a position spaced from the movable body by a predetermined distance before the movable body begins to move.

9. The paper clamping apparatus for an office machine as claimed in claim 7, wherein the clamp base or the shaft holder is adapted to maintain a position spaced from the movable body by a predetermined distance before the movable body begins to move.

* * * * *